United States Patent [19]

Neumann et al.

[11] Patent Number: 4,946,214

[45] Date of Patent: Aug. 7, 1990

[54] CONTAINER COLLAPSIBLE TO FORM A FLAT PLATFORM STRUCTURE

[76] Inventors: Dietmar J. Neumann, 67 Lakeshore Rd., Pointe Claire, Quebec, Canada, H9S 4H5; Josef Linecker, Salzburgerstrasse 9, A-5230 Mattighofen, Australia

[21] Appl. No.: 183,447

[22] Filed: Apr. 13, 1988

Related U.S. Application Data

[63] Continuation-in-part of Ser. No. 921,076, Oct. 21, 1986, abandoned.

[30] Foreign Application Priority Data

Oct. 25, 1985 [AT] Austria ..... 3086/85

[51] Int. Cl.[5] ..... B60P 3/42

[52] U.S. Cl. ..... 296/10; 105/243; 296/27; 296/39.3; 222/105; 298/24; 410/54; 410/58; 410/119

[58] Field of Search ..... 280/656, 783; 105/343, 105/363; 410/54, 58, 117–119, 156; 298/24, 25; 296/10, 27, 39.1, 39.3, 24.1; 222/105, 183, 386.5

[56] References Cited

U.S. PATENT DOCUMENTS

| | | | |
|---|---|---|---|
| 276,017 | 4/1883 | Foster | 105/243 |
| 799,646 | 9/1905 | Hart | 105/243 |
| 2,720,998 | 10/1955 | Potter | 222/105 X |
| 2,768,021 | 10/1956 | Kaster | 296/10 |
| 2,807,499 | 9/1957 | Duddleston | 296/100 |
| 2,956,839 | 10/1960 | Hermanns | 222/386.5 |
| 3,037,807 | 6/1962 | Hicks | 296/10 |
| 3,155,419 | 11/1964 | Garson et al. | 296/181 |
| 3,199,726 | 8/1965 | Pierson | 222/105 X |
| 3,222,099 | 12/1965 | Swallert | 296/10 |
| 3,372,725 | 3/1968 | Voorhees | 222/105 X |
| 3,494,509 | 2/1970 | McGuire | 222/107 |
| 3,502,240 | 3/1970 | Paton | 220/22 |
| 3,756,469 | 9/1973 | Clark et al. | 105/243 X |
| 3,880,459 | 4/1975 | Kelley | 296/27 |
| 3,941,258 | 3/1976 | Ide | 222/386.5 |
| 4,092,051 | 5/1978 | D'Orazio | 298/24 |
| 4,101,158 | 7/1978 | Jones | 296/10 |
| 4,155,469 | 5/1979 | Cole | 298/27 |
| 4,405,169 | 9/1983 | Allard et al. | 410/386.5 |
| 4,497,259 | 2/1985 | Titterton | 105/243 X |
| 4,557,400 | 12/1985 | Clarke | 105/243 X |
| 4,606,570 | 8/1986 | Neumann | 296/10 |

FOREIGN PATENT DOCUMENTS

| | | |
|---|---|---|
| 213329 | 2/1961 | Austria . |
| 0141429 | 5/1985 | European Pat. Off. . |
| 1243091 | 6/1967 | Fed. Rep. of Germany . |
| 2260646 | 6/1974 | Fed. Rep. of Germany . |
| 2308029 | 9/1974 | Fed. Rep. of Germany . |
| 2451052 | 5/1976 | Fed. Rep. of Germany . |
| 2724715 | 12/1977 | Fed. Rep. of Germany . |
| 2806575 | 8/1979 | Fed. Rep. of Germany . |
| 3310720 | 9/1984 | Fed. Rep. of Germany . |
| 3317221 | 11/1984 | Fed. Rep. of Germany . |
| 2335425 | 7/1977 | France . |
| 1005603 | 9/1965 | United Kingdom . |
| 1298488 | 12/1972 | United Kingdom . |

*Primary Examiner*—Kevin P. Shaver
*Attorney, Agent, or Firm*—Fetherstonaugh & Co.

[57] ABSTRACT

A collapsible container has a top frame and bottom frame with folding walls having predetermined fold lines therein. The container has a closed position which is a flat platform configuration. In this configuration the walls are folded within the platform which may be used as a pallet for piece goods. The container has an open position where the top frame is raised and the container can be integral with a wheeled vehicle and used as a bulk carrier. Thus the container can be used for one shipment as a pallet for piece goods and for a next shipment as a bulk carrier.

26 Claims, 8 Drawing Sheets

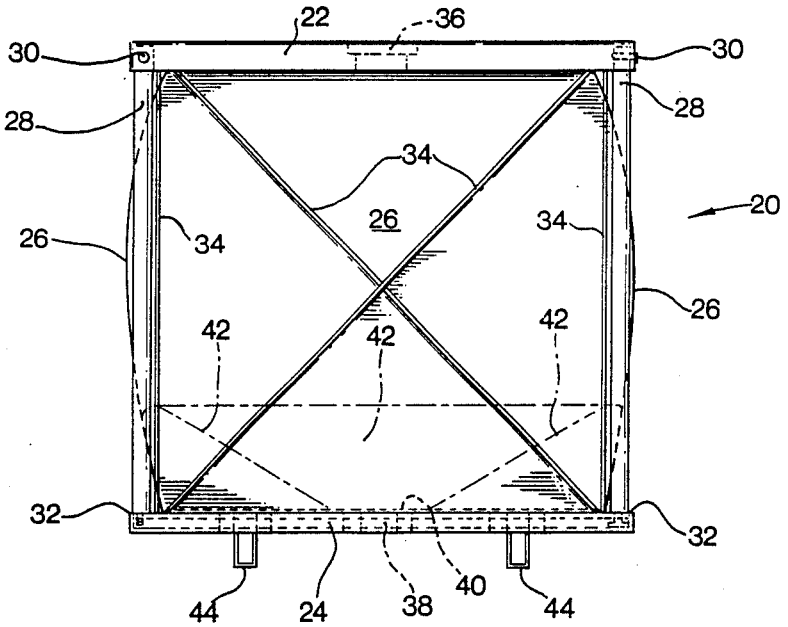
FIG. 1
FIG. 2
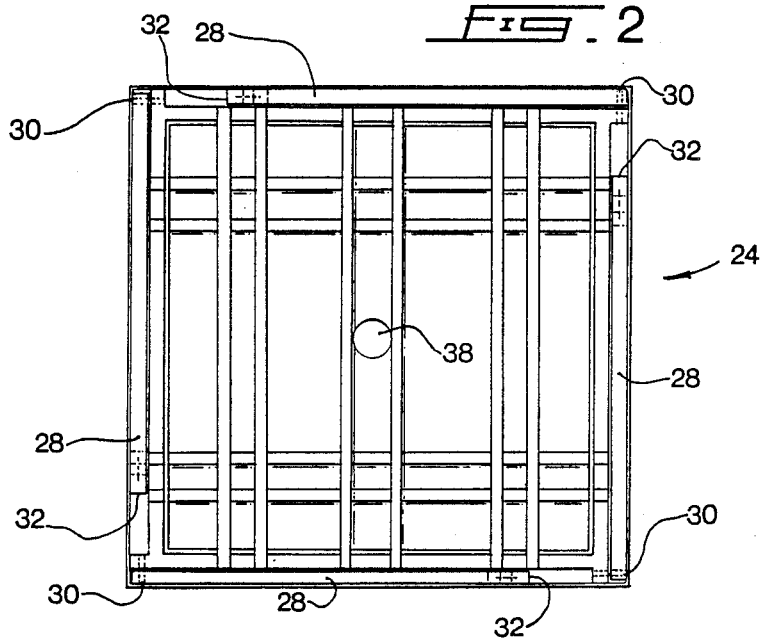

CONTAINER COLLAPSIBLE TO FORM A FLAT PLATFORM STRUCTURE

This application is a Continuation-in-part application of Ser. No. 921,076 filed Oct. 21, 1986 now abandoned.

This invention relates to a collapsible container having folding walls on at least two sides.

More specifically this invention relates to a collapsible container with a closed position having a flat platform configuration.

Almost all existing units such as containers, bulk carriers and vans are designed to transport specific materials and often have special shapes for their specialized purposes. The units are usually built out of rigid materials, preferably metal, which cannot be altered. The result of this is due to the lack of product availability, many return trips must be made with the units empty. This means that transportation costs are high since the empty return trip involves almost as much energy consumption, time, personnel and wear. Individual containers are often stacked over long periods of time until they can be returned or a return load can be found, tying up inventory and using valuable storage space.

The present invention provides a container with flexible or folding walls which allow the container to be reduced to about 5 to 10% of the transportation volume within a few minutes after it has been emptied. The surface of the collapsed or folded container can then be used as a loading surface for the transportation of other products such as packaged piece goods, structural materials etcetera. Depending upon the reduction in volume, some 10 to 20 containers in the collapsed or folded state take up the volume of one container which reduces the costs of the return trip. Thus, bulk carrier equipment and van units according to the present invention may be put to the most efficient use for the transportation of goods in both directions, due to the container capability to alter its shape and shipping volume. This results in a considerable savings in distance travelled, less energy is used, there is less environmental pollution, and the overall transportation costs of all goods are reduced.

In the case of existing units such as containers, bulk carriers and vans, the space enclosing function and the stiffening function are usually performed by the same materials, preferably metals.

In the case of containers according to the present invention, however, on at least two sides the space enclosing function and the stiffening function, especially the lateral rigidity, are obtained by the use of separate elements usually made of very different materials. Depending upon whether the containers, bulk carriers or vans according to the present invention are to be used for gases, liquids or piece goods, they vary in detail and shape, but retain the basic design principle. For example, the size, especially the height of the container is also governed by the density of the goods it is intended to carry, so that in the case of, for example, light, granular material, maximum volume is obtained in order to achieve maximum utilization of the load carrying capacity of the vehicle or chassis. Containers, bulk carriers or vans according to the present invention may also be built in such a manner that when partly filled the volume is adapted to the partly filled condition and this is especially of considerable advantage for the transportation of liquids.

Known systems may easily be adapted for loading and unloading. However, special methods may also be used to increase efficiency and reduce structural costs. Where small piece goods are to be transported, filling and emptying apertures of any desired size, or even full size hinged single or multi leaf doors or folding doors may be provided on the sides and/or the roof of the containers, bulk carriers or vans.

Furthermore, in the case of rapidly changing uses, it is possible to have non-load carrying internal container liners made, for example, of transparent, highgrade, easily cleaned plastic film.

The lateral walls may be made of two or more sheets of the same or different materials. They may also be designed as interconnected flexible tubular walls so that they can be filled with an appropriate medium. This flexible form may also be used with great advantage when the container, bulk carrier or van is only partly filled.

The floors or roofs of such containers, bulk carriers or vans may also consist of one or more layers so that the spaces between them can be filled, especially during unloading with a constant or pulsating flow of a suitable medium, preferably air, in order to facilitate and accelerate the unloading process. For instance, a flexible liner may be placed in a hopper at the bottom of the container, and air pulsated between the hopper and the liner to help in unloading bulk materials.

In order to increase the volume of the cargo space, a trough may be fitted between the main longitudinal members, the trough being lined with a flexible material and being continuous over the greatest possible use of the space. In order to ensure that when granular or powder goods are being properly unloaded, specially shaped cushions, preferably inflatable with air, are installed in between the emptying apertures. When inflated, these cushions provide a hopper shaped area in the vicinity of the emptying aperture capable of producing vibration and/or an air layer to assist in the complete discharge of the materials. During transportation, however, the cushions may also be filled with other special goods, preferably liquids, to be transported. Pressurizing the cushions during transportation, assists in securing the load by taking up any air space.

Before loading, the roof of the container, bulk carrier or van is raised, in one embodiment by the application of positive air pressure. After unloading, a vacuum may be provided in the container or bulk carrier so that the flexible lateral walls are folded inwardly into a clearly defined shape. During the unloading of granular or powder goods it may be advantageous to produce a pulsating vacuum and/or to pulsatingly inflate and deflate the double layer, flexible, lateral walls. This makes it possible to unload granular or powder goods very quickly, either with or without a slight positive pressure.

The flexible, lateral walls bulge outwardly depending upon the material being loaded, the loading height and the preload, in order to achieve the necessary carrying capacity and safety.

Although the containers, bulk carriers and vans according to the present invention may be specially built and modified for the transportation of various kinds of goods, they are based upon the principle that after being unloaded they can be collapsed or folded within a short time, to a fraction of their original volume, in order to take up a minimum of space for the return trip, or, in the case of bulk carriers and vans, can make the roofs available for transporting other goods, preferably piece goods.

In one embodiment, the double layer side walls may be used to keep the cargo hot or cold. If necessary, flexible bracing elements such as tension belts may be provided to reinforce the side walls, particularly the fold lines. At least for the transportation of granular goods, a vacuum in the cargo space can substantially increase lateral stability around curves.

In one embodiment, goods can be loaded on a container in the flat platform configuration, delivered to a required site, the goods removed from the platform and the container opened so it can be used as an emergency shelter or storage in the field. A number of containers may be attached together for a multi room emergency accommodation or storage.

The present invention provides in one embodiment a collapsible container having a closed position forming a flat platform configuration, and an open position, the container comprising a rectangular top frame; a rectangular bottom frame at least as large as the top frame and substantially parallel to the top frame; collapsible strut members, each having a pivot connection at one end to a side of one frame, and a sliding connection at the other end to a side of the other frame, such that the collapsible strut members are substantially perpendicular to the top and bottom frame in the open position and substantially parallel to the top and bottom frame and within the flat platform configuration in the closed position; at least two opposing walls connected to the top frame and the bottom frame, the walls having predetermined fold lines therein between lateral surfaces to ensure the walls fold and unfold on the fold lines within the platform configuration; and means for raising the top frame to the open position, and for lowering the top frame to the closed position.

In a further embodiment, there is provided a collapsible container integral with a wheeled vehicle having a closed position forming a flat platform configuration, and an open position, the container comprising: a rectangular top frame; a rectangular bottom frame substantially parallel to the top frame extending outwardly beyond opposing sides of the top frame; two side panels, each hingedly connected to the opposing sides of the top frame, extending outwardly from the top frame, each of the panels slidably connected at opposing ends to the bottom frame, the side panels being sloped upwards to the top frame when the container is in the open position, and flat, substantially in the same plane as the top frame when the container is in the closed position; locking means to lock the opposing ends of the side panels to the bottom frame at least when the container is in the open position; two opposing walls connected to the other opposing sides of the top frame and the bottom frame, the walls having predetermined fold lines therein between lateral surfaces to ensure the walls fold and unfold on the fold lines within the platform configuration; and means for raising the top frame to the open position, and for lowering the top frame to the closed position.

Variants of the basic principle and examples of embodiments of the invention are illustrated in the drawings attached hereto and the most important details are explained in greater detail hereinafter without in any way restricting the invention.

FIG. 1 is a side view of one embodiment of a container according to the invention;

FIG. 2 is a top plan view of the bottom frame of the container shown in FIG. 1;

Figure 3:
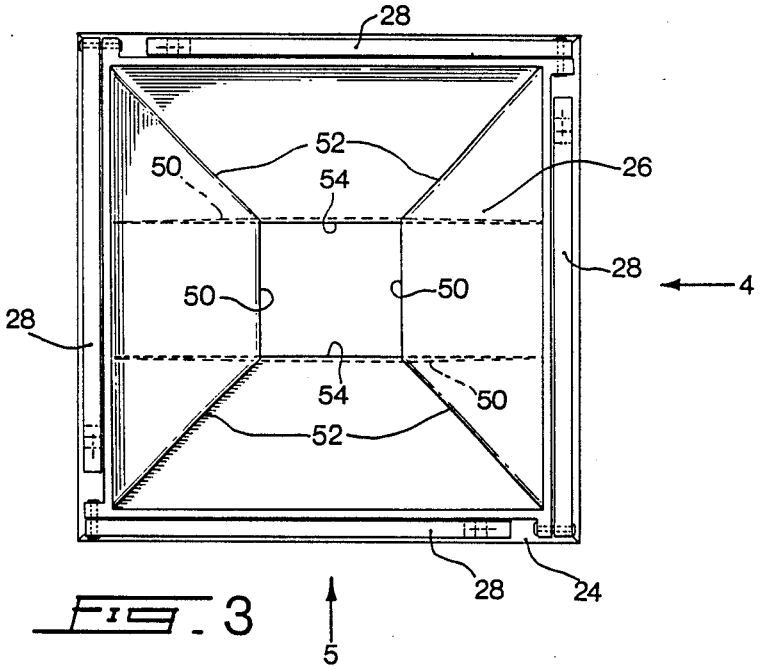
FIG. 3 is a top plan view of another embodiment of a container according to the present invention in the closed position with the walls folded and the top frame removed.

Referring now to the drawings:

FIG. 1 illustrates a side or end view of one container according to the present embodiment which has a rectangular top frame 22 and a rectangular bottom frame 24. The container is shown in a fully open position and has multi layered flexible lateral walls 26 which are shown bulging outwards and are attached to both the top frame 22 and the bottom frame 24. The walls 26 have fold lines therein which will be described hereafter. Collapsible strut members 28 are provided in the four corners of the container 20. When in the open position, each strut member 28 has a pivot connection 30 to the top frame 22 positioned in the corner and a sliding connection 32, which will be described hereafter in more detail, at the bottom of the strut member 28 which slides in a suitable track on the bottom frame 24.

FIG. 2 illustrates the bottom frame 24 with the strut members 28 lying flat on the bottom frame 24. The sliding connections 32 slide backwards and forwards in the frame members of the bottom frame 24 and the other end of the strut members 28 are connected by a pivot connection 30 to the top frame 22.

As shown in FIGS. 1 and 2, the container in this particular case is substantially square and all of the walls are formed of flexible material. Tension cable elements 34 are placed either within the walls 26 of the container extending diagonally between corners or, alternatively, outside the walls 26 of the container, in which case the cables 34 are preferably attached to the flexible walls by fabric loops so that when the walls 26 fold, the cables 34 remain attached to the walls. The tension cable elements 34 provide lateral stabilization and are needed particularly when heavy bulk goods are to be transported in the container. For light loads, the tension cable elements 34 may be omitted. Arranged centrally on the top frame 22 of the container is a filling aperture 36 and in the bottom frame of the container is an outlet aperture 38. In one embodiment the filling aperture 36 may be replaced by two folding doors opening upwards which are formed in the top frame 22.

In a specific embodiment illustrated in FIG. 1, a rectangular inflatable liner 40 is shown located on the bottom frame 24, having a hole at its center and when inflated having sloped surfaces 42 extending upwards from the outlet aperture to the side walls 26. When the liner 40 is inflated, it provides a hopper shape enabling any granular or powder goods therein to empty through the outlet aperture 38. Furthermore, air may be pulsated into the inflatable liner 40, the pulsating effect acting as a vibrator to assist in discharging material from the container.

A detail of the bottom frame 24 is illustrated in FIG. 2. As can be seen, it has structural frame members extending in a lattice configuration. A liner or base is provided for the container resting on the frame 24 which may or may not be inflatable. As shown in FIG. 1, retractable feet 44 extend down below the bottom frame 24 to act as legs and raise the bottom frame off the ground. In one embodiment, the retractable feet 44 are pneumatically activated and compressed air is supplied to a piston in a cylinder to lower the feet and raise the container off the ground or floor. Mechanical locks lock the feet 44 in position. In order to retract the feet 44, air is evacuated from the cylinder and the feet are raised to then become flush with the bottom of the bottom frame 24.

Figure 4:
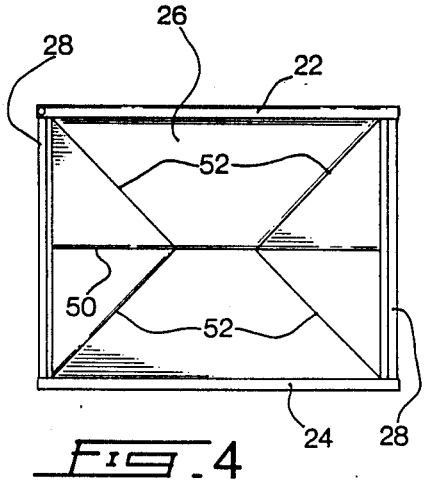
FIG. 4 is an end view of the container shown in FIG. 3 at arrow 4.
Figure 5:
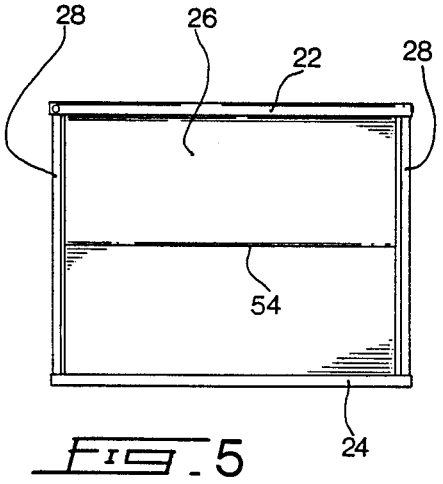
FIG. 5 is a side view of the container shown in FIG. 3 at arrow 5.
Figure 6:
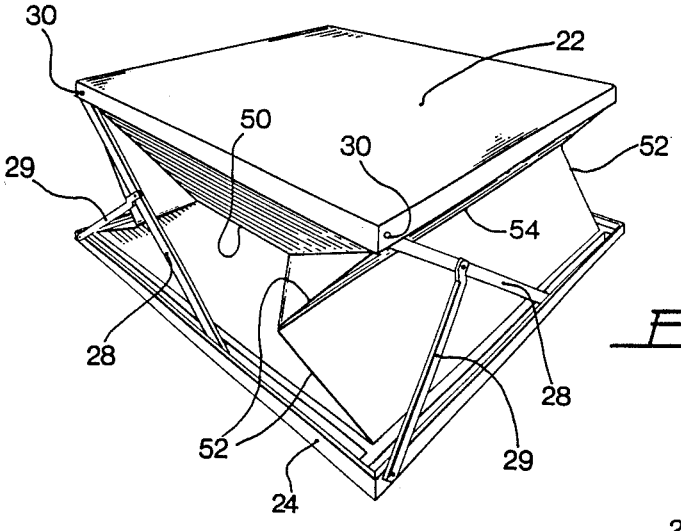
FIG. 6 is an isometric side view of the container shown in FIG. 3 in the midway position between the open position and the closed position.

FIGS. 3 to 6 illustrate a container having either flexible walls 26 or rigid walls which have fold lines therein. FIG. 3 illustrates the container in the folded position showing the walls 26 of the container folded inwards. FIG. 4 illustrates what might be referred to as an end view of the container and has a center fold line 50 in the wall 26 which extends substantially at the mid point across the end wall 26 parallel to the top frame 22 and the bottom frame 24. Four diagonal fold lines 52 extend from the four corners of the wall 26 at an angle of 45° into the center fold line 50. FIG. 5 illustrates a side view of the container which has only a center fold line 54 extending across the side wall 26 in line with the center fold line 50 in the end wall 26. As can be seen in FIG. 3, when folded, the center fold line 54 in the side wall 26 moves in towards the center of the container. The diagonal fold lines 52 fold down upon themselves and as they fold, the center fold line 50 in the end wall 26 shown in FIG. 4 swings through an angle of approximately 90° so that as can be seen in FIG. 3, the center fold line 50 ends up by forming a U configuration. FIG. 6 illustrates the fold lines with the container at approximately the mid point between the open position and the closed position.

Also shown in FIG. 6 are intermediate strut members 29 extending from the corner on the bottom frame 24 directly below the pivot connection 30 on the top frame 22 to the approximate center of each strut member 28. The intermediate strut members 29 restrict twisting of the top frame 22 relative to the bottom frame 24 when the container is folding and unfolding.

Figure 7:
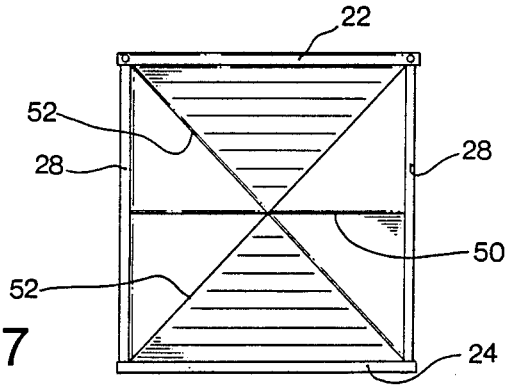
FIG. 7 is an end view of another container according to the present invention showing the fold lines in the walls.

FIG. 7 illustrates a square end wall 26 wherein the diagonal fold lines 52 extend from corner to corner through the center fold line 50 and do not have a space between the lines as shown in the rectangular wall 26 of FIG. 4.

Figure 8:
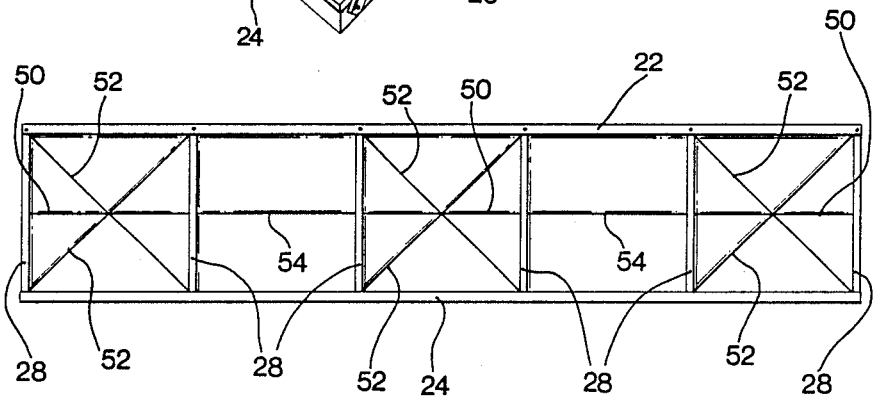
FIG. 8 is a side view of another container according to the present invention showing several compartments.

FIG. 8 illustrates a rectangular shaped container which has five separate compartments, the two outside and the center compartments illustrate end walls with fold lines 50, 52 similar to that shown in FIG. 7 and the two intermediate compartments have side walls with fold line 50 similar to that shown in FIG. 5. The fold lines illustrate that the end wall of one compartment adjacent the side wall of the next compartment provides a stable multi compartmented container. Collapsible strut members 28 are illustrated and as in the case of the other containers, either the bottom of each strut member or the top of each strut member slides in the top or bottom frame so that when the container is flat, the strut members 28 lie substantially parallel to the top frame 22 and the bottom frame 24.

The opening and closing of the container may be done by a number of ways. In one configuration, an air connection is provided to the container at the filling aperture 36 and air under pressure is blown into the container so that the walls unfold about fold lines 50, 52, 54; the top frame 22 rises upwards and the collapsible strut members 28 move from the horizontal position to the vertical position. A locking mechanism is provided so that the strut members 28 can be locked when they are in the open position. In another embodiment, the strut members 28 may be locked in position between the open and closed positions. This is particularly useful when it is only required to partially fill the container.

In another embodiment there is provided four individual drive elements in the form of worm gear drives or compressed air cylinders for each collapsible strut member 28, the individual drive elements move the sliding connection 32 along channels in the bottom frame 24 so that the strut members 28 pivot about the pivot points 30 and the top frame 22 rises. To lower the container from the open position to the closed position, it is merely necessary to reverse the drive units. When compressed air is used, it is merely necessary to exhaust air from inside the container so that the container collapses, the locking mechanism for the collapsible strut members 28 are unlocked before the top frame 22 can be lowered.

The walls may be formed from flexible thermoplastic material, preferably multi layered, and the fold lines may be made by suitable joints or hinges or by heating the thermoplastic coating in the folded condition, or by applying additional coatings in the folded condition or, alternatively, by gluing or welding reinforcements or reinforcing sections in the folded condition. In this way, it is ensured that when the container folds and unfolds, the wall sections will always fold about the predetermined fold lines. It is necessary to avoid sharp edges or sharp corners in the walls in order to lengthen service life and increase load carrying capacity.

Figure 9:
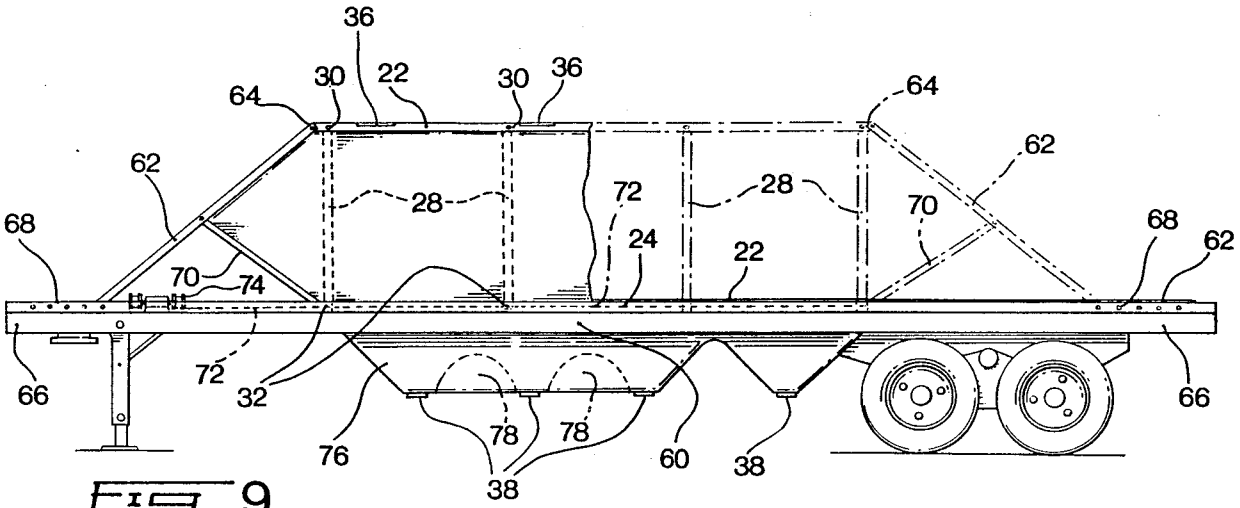
FIG. 9 is a side view of another embodiment according to the present invention showing a container integral with a wheeled vehicle, the left half of the figure illustrates the container in the open position and the right half of the figure illustrates the container in the closed position.
Figure 10:
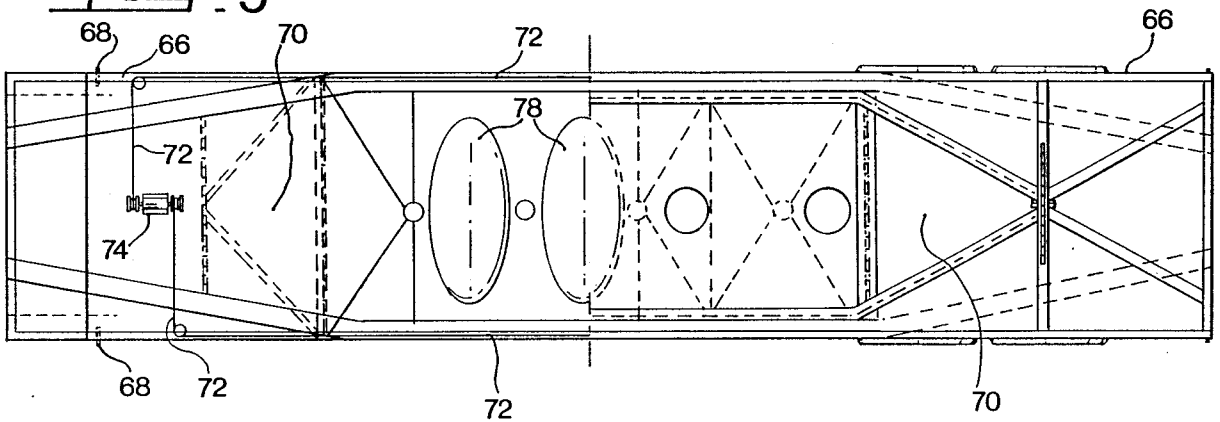
FIG. 10 is a top plan view of the container shown in FIG. 9.

FIGS. 9 and 10 illustrate a bulk carrier in the form of a trailer for road transportation. A railcar containing the container may also be provided. In both cases the container provides a low center of gravity for the vehicle making it particularly suitable for heavy goods.

FIG. 9 on the left hand side illustrates the container in the open position and on the right hand side in the closed position with the structure in the open position shown in dotted line. The bottom frame 24 is integral with the trailer body frame 60. The top frame 22 has two side panels 62 joined to the top panel 22 at hinge connections 64. The bottom frame 24 has extension pieces 66 at both ends and the bottom edges of the side panels 62 slide in channels provided in the end pieces 66 so the edges move horizontally on the end pieces 66. When the container is in the open position, the side pieces 62 slope upwards to the hinge connection 64 on the top frame 22. When the container is in the closed position, the end pieces 62 and the top frame 22 are flat and substantially in line so that the trailer becomes a flat trailer or flat car. Piece goods can then be transported on the trailer in this form.

A locking arrangement 68 which in one embodiment comprises a pin at each corner of the side panel 62, passes through one of a series of holes in the channels provided in the end pieces 66, locking the side panels 62 in position. Thus the side panels are locked in position, either when the container is in the open position or when it is at any location between the open position and the closed position. Support panels 70 are shown extending from the approximate center of the side panel 62 to a position on the bottom frame 24 substantially underneath the hinge 64 between the side panel 62 and the top frame 22. This support panel 70 may be used to support a pyramidal shaped liner portion as will be described hereafter. Furthermore, the space under the support panel 70 and the lower portion of the side panel 62 may be used for an inflatable air bag which can be supplied for raising the top frame 22 of the container 22. When the container is in the closed position, the support panels 70 lie flat in the same plane as the side panels 62 and the bottom frame 24.

Collapsible strut members 28 are illustrated in dotted lines in FIG. 9. These may not be required if light materials are to be carried in the container, however, if heavy materials are to be carried, then the strut members 28 are required. In the embodiment shown, the top of the strut members 28 are pivoted to the top frame 22 and the bottom of the strut members 28 all have cables 72 attached to a sliding foot 32 which slides in channels or grooves on the sides of the bottom frame 24. The cables 72 are connected together and pass over guided rollers to a cable winch 74. When the winch is operated, all the sliding feet 32 of the strut members 28 slide in the channels or grooves on the bottom frame 24 so that the top frame 22 is raised. Diagonal tension cable elements 34 are also illustrated in dotted lines in the container extending between top and bottom corners of the containers. These cable elements 34 are required for heavy materials when extra strength is needed in the walls of the container.

Whereas FIG. 9 shows the side panels 62 sloping down to the level of the bottom frame 24 in another embodiment where more cargo space is required, the side panels may rise upwards at the extremities, so they do not slope down as far as the level of the bottom frame and may even remain substantially level with the top frame 22 or become part of the top frame 22.

The size of the cargo space in the container is increased by the addition of a trough 76 beneath the container fitting between the structural members of the trailer body frame 60. Discharge outlets 38 with appropriate covers are placed at positions along the bottom of the trough 76. In order to assist emptying granular or powder materials, inflatable linings or cushions 78 are provided between the discharge outlets 38 by inflating these liners or cushions 78 a hopper is formed directing the granular material to the discharge outlets 38. By applying a pulsating flow of air, the material in the container is urged by vibration towards the discharge outlets 38. In another embodiment, the trough 76 as a whole may be lined with flexible sheet layer and air under pressure may be blown between the trough and the flexible lining whereby the material in the container is vibrated to assist in emptying the container.

Figure 12:
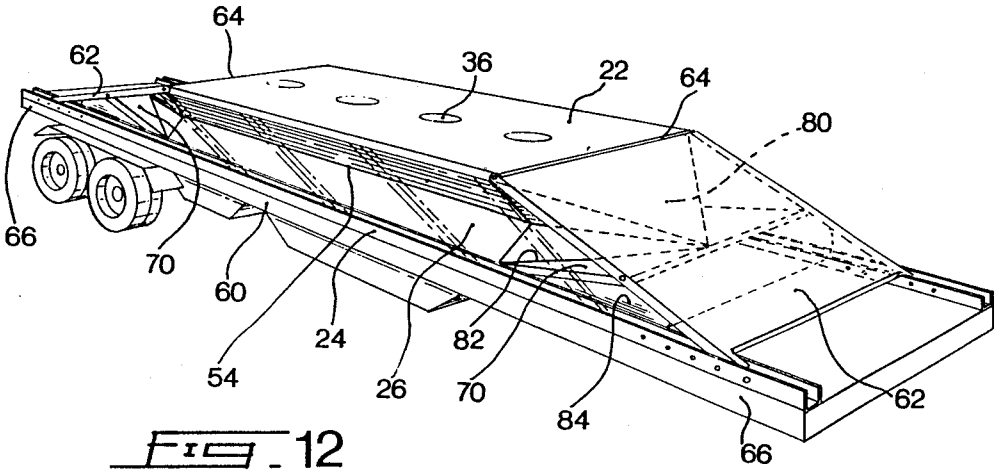
FIG. 12 is an isometric side view of the container shown in FIG. 11 with the container midway between the open position and the closed position.
Figure 11:
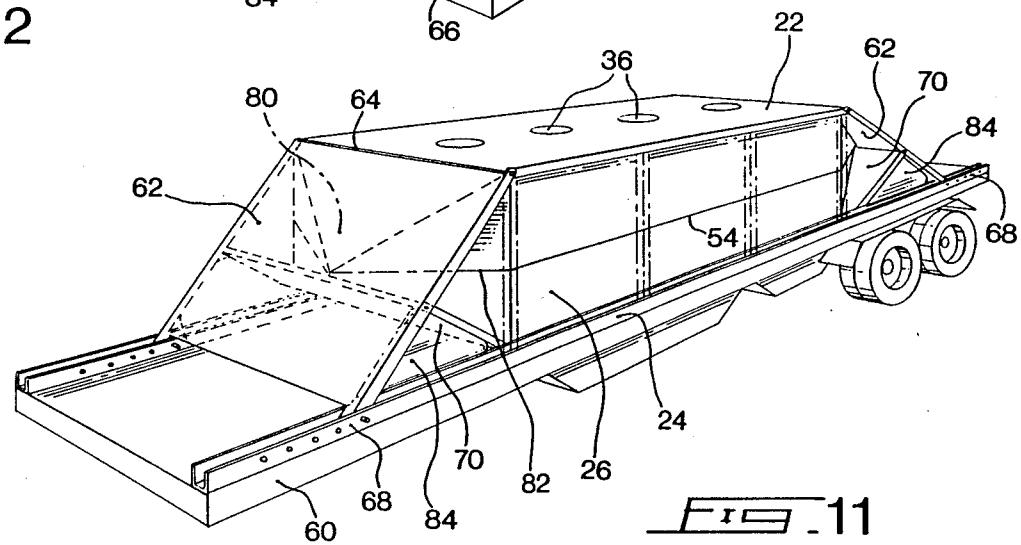
FIG. 11 is an isometric side view of another container integral with a wheeled vehicle with the container in the open position.

As in the case of the container described heretofore, FIG. 11 and 12 show side walls 26 which have a center fold line 54 similar to the container of FIG. 5. The end wall, however, is different in that it has in the open position a pyramid configuration 80 which extends to rest on the support panel 70. The pyramid shaped end 80 has a fold line 82 along its center as illustrated in FIGS. 11 and 12 and during the folding when the container is moving from the open position to the closed position, the fold line 82 moves inward with the fold line 54 of the side wall 26. Beneath the support panels 70 is an inflatable cushion 84 which may be used to raise the top frame 22, alternatively, it may be used as a liquid storage for transportation of liquid products. If it is used as a means for raising the top frame 22, then compressed air is supplied to the inflatable cushion 84. Another way of raising the top frame 22 is by pressurizing the container through an air connection at the filling apertures 36 or at another location as provided. In the case of flexible lateral walls, horizontal tension cables in the walls may be provided to reduce bulging and this is particularly applicable when heavy loads are to be carried in the container. Furthermore, by utilizing tension cables, lateral stability of the container is not controlled by the top frame 22, thus it may be made of lighter material contributing substantially to a reduction in the weight of the container and also contributing to a lower center of gravity.

Figure 13:
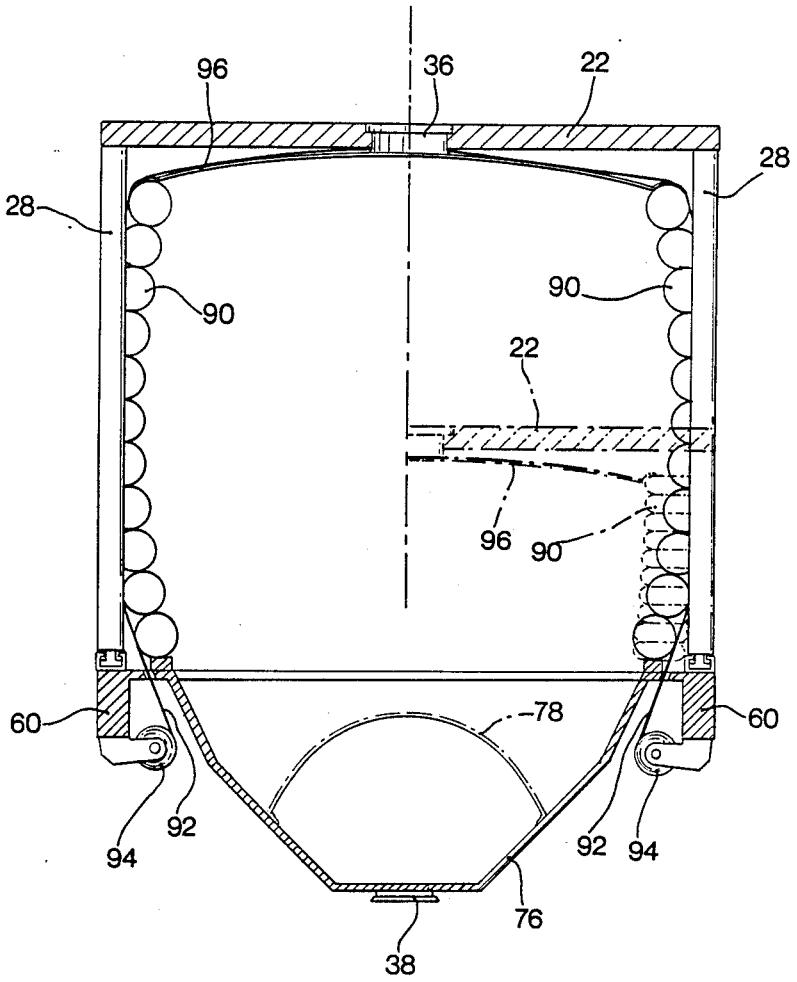
FIG. 13 is an end cross sectional view through the container integral with a wheeled vehicle shown in FIG. 9 showing another embodiment with double layered side walls.

A cross section through a bulk carrier of the type shown in FIGS. 9 and 10 is illustrated in FIG. 13. The side walls in this configuration are double wall layers of flexible plastic material and are inflated to form round tubular members 90. When the tubular members 90 are fully inflated, a height of about 70% of the maximum height of the container is attained. For maximum height it would be necessary to raise the top frame 22 still further. Furthermore, partial filling may be attained as shown on the right hand side of the drawing when the tubular members 90 are only partially inflated. Vertical tensioning belts 92 are provided. These belts extend from drums 94 located on the inside of the structural members of the trailer body frame 60 and may be tensioned so that the height of the container is controlled by the contents of the container. In this embodiment, a top liner 96 extends across the top of the container and the tubular members 90, beneath the top frame 22. The tension belts 92 extend around the tubular members 90 over the top liner 96 and down to the other side and are tensioned by the drums 94.

The tubular members 90 may also be filled with liquids to be transported or they may carry heating or cooling media for the materials inside the container. Adjustment to lower filling heights is particularly advantageous since this prevents liquid from sloshing backwards and forwards or side to side during transportation, thus improving the road stability of the vehicle.

Figure 14:
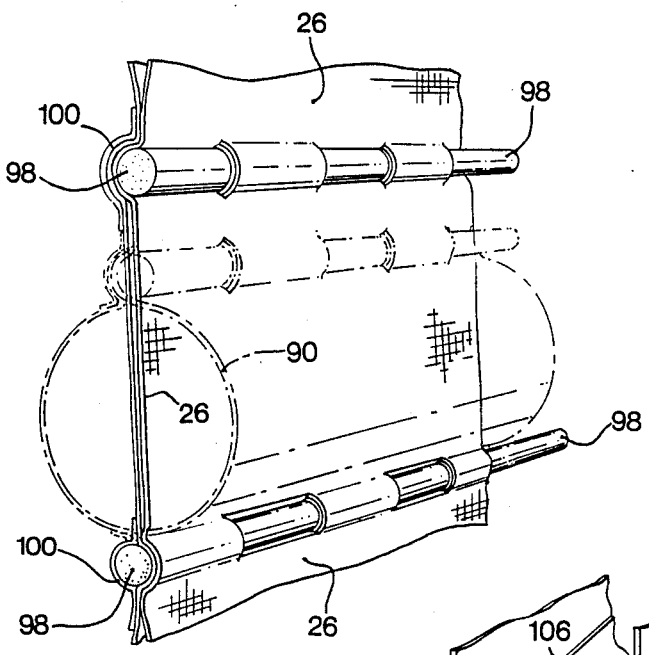
FIG. 14 is a detailed isometric side view of one embodiment of a double layered side wall as shown in FIG. 13.

FIG. 14 illustrates a two layer wall design made of high strength fabrics and coated for sealing purposes. Synthetic fiber fabrics are available in widths corresponding to the height of the flexible lateral walls of the container, thus joints and weld seams may be eliminated.

Figure 15:
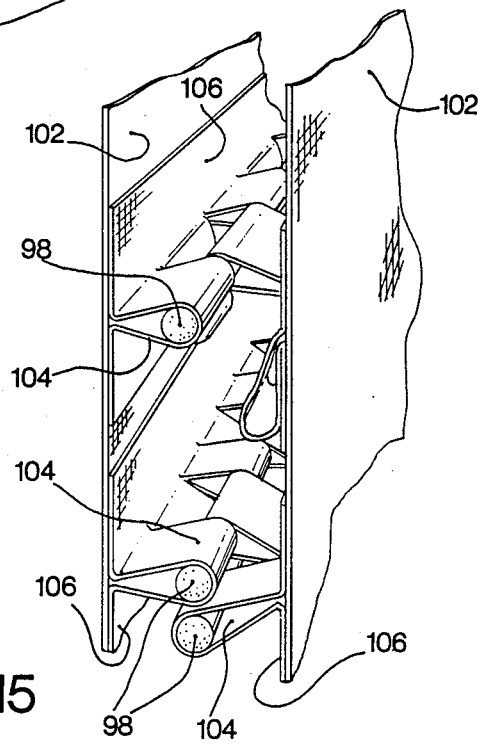
FIG. 15 is a detailed isometric side view of another embodiment of a double layered side wall.

Horizontal tensioning cables or rods 98 spaced substantially equally apart pass through a series of vertical slots cut in two layers forming the multi layered wall. The tensioning cable 98 weaves through the slots so that portions of the two layer lateral wall pass on one side of the cable 98 and the adjacent portions pass on the other side of the cable 98. Strips of fabric 100 are applied to the inside or outside of the lateral wall surrounding the cable 98 to seal the slots. The double wall may then be inflated to form tubes as shown in the drawing. FIG. 15 shows another embodiment wherein two layers of coated fabric 102 are spaced one from the other and are not slotted as shown in FIG. 14. Separate fabric loops 104 extend around the cables 98 and have short strips 106 attached on either side which are firmly attached to the inside of the two layers of coated fabric 102. The space between the two layers 102 and the cables 98 can then be inflated to form a tubular member 90. As illustrated in the lower portion of FIG. 15, two cables 98 are provided with separate loops 104 applied to each cable staggered along the length of the wall. A central layer may be supplied to divide the wall section into two compartments thus forming a double layered wall structure. The predetermined fold lines occur at the mid point of the tubular members 90. Reinforcing strips may be included at these fold line locations if necessary.

Figure 16:
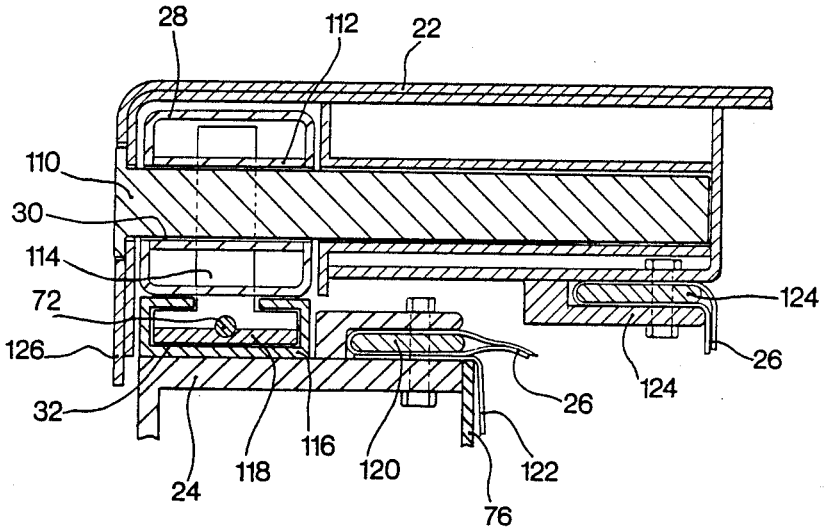
FIG. 16 is a cross sectional view showing one embodiment of a corner detail of a top frame and a bottom frame with the container in the closed position.

A corner detail of a top frame is shown in FIG. 16. This detail is applicable to a container of the type shown in all the previous figures, with the exception of FIGS. 13 to 15. The collapsible strut member 28 has a top pivot position 30 with a pin 110 or shaft passing through a hole 112 in the strut member 28. A T-shaped sliding foot 114 is connected by means of a pin (not shown) to the other end of the strut member 28 and slides within a C-shaped guide 116 which is attached to the bottom frame 24. The individual T-shaped shoes 114 are joined together by a base strip 118 thus ensuring that all the strut members 28 move together and have the same angle. A connecting cable 72 connects the strut members 28 to a winch 74 as shown in FIG. 10.

A clamp arrangement 120 is provided on the bottom frame 24 which clamps the flexible lateral wall 26 and also a liner 122 extending down into the trough 76. A top clamping arrangement 124 is provided beneath the top frame 22 and holds the top edge of the flexible lateral wall 26.

The top frame 22 has a skirt 126 which overlaps the bottom frame 24 for protection purposes when the container is in the closed position. The top of the top frame 22 is preferably steel plate or also may be made out of other suitable material such as aluminum or wood.

Preferred embodiments of the invention have been illustrated by way of specific detailed examples. It is to be expressly understood, however, that the description and drawings are only for the purpose of illustration and as an aid to understanding the invention and are not intended as a definition of the limits of the invention.

Various changes may be made to the embodiments described herein without departing from the scope of the present invention which is limited only by the following claims.

The embodiments of the invention in which an exclusive property or privilege is claimed are defined as follows.

1. A collapsible container having a closed position forming a flat platform configuration, and an open position, the container comprising:

a rectangular top frame;

a rectangular bottom frame at least as large as the top frame and substantially parallel to the top frame;

collapsible strut members, each having a pivot connection at one end to a side of one frame, and a sliding connection at the other end to a side of the other frame, such that the collapsible strut members are substantially perpendicular to the top and bottom frame in the open position and substantially parallel to the top and bottom frame and within the flat platform configuration in the closed position;

at least two opposing walls connected to the top frame and the bottom frame, the walls having predetermined fold lines therein between lateral surfaces to ensure the walls fold and unfold on the fold lines within the platform configuration; and means for raising the top frame to the open position and for lowering the top frame to the closed position.

2. The container according to claim 1 wherein the walls are multi layered and flexible.

3. The container according to claim 1 wherein said two opposing walls are rectangular in shape, said fold lines including a center fold line extending parallel to the top frame and the bottom frame substantially in the center of each of the two walls, and four diagonal fold lines extending from each of the four corners of the center fold line.

4. The container according to claim 3 further comprising another two opposing walls each having a fold line extending parallel to the top frame and the bottom frame, substantially in the center of each of said another two opposing walls.

5. The container according to claim 1 further comprising another two opposing walls, said opposing walls are multi layered, are flexible and are joined together at adjacent vertical corners.

6. The container according to claim 1 wherein the means for raising the top frame to the open position and lowering the top frame to the closed position comprises means for sealing the container and airline connection means for supplying pressurized air to and evacuating air from inside the container.

7. The container according to claim 1 including a plurality of tension cable elements extending diagonally from corners on the top frame to corners on the bottom frame.

8. The container according to claim 1 wherein multi layered flexible walls divide the container into a plurality of compartments.

9. The container according to claim 1 wherein retractable feet are provided below the bottom frame, the feet retractable by compressed air.

10. The container according to claim 1 wherein stiffening strips are provided on at least some of the predetermined fold lines.

11. The container according to claim 1 wherein the walls have at least two layers joined to each other at connecting locations between the top frame and the bottom frame to form a plurality of tubular members substantially parallel to the top frame and the bottom frame.

12. A container according to claim 11 wherein the tubular members are filled with compressed air to provide the means for raising the top frame.

13. The container according to claim 11 wherein the tubular members are filled with an insulating medium to provide protection against heat and cold.

14. The container according to claim 11 wherein the tubular members are pressurized at different pressures to adjust height of the container.

15. The container according to claim 11 wherein tensioning cables extend at the connecting locations joining adjacent tubular members together, the tensioning cables providing a lateral support for the walls.

16. The container according to claim 1 wherein the strut members are lockable when the container is in a partially open position.

17. A collapsible container integral with a wheeled vehicle having a closed position forming a flat platform configuration, and an open position, the container comprising:

a rectangular top frame;

a rectangular bottom frame substantially parallel to the top frame extending outwardly beyond opposing sides of the top frame;

two side panels, each panel hingedly connected to the opposing sides of the top frame, extending outwardly from the top frame, each of the panels slidably connected at opposing ends to the bottom frame, the side panels being sloped upwards to the top frame when the container is in the open position, and flat, substantially in the same plane as to the top frame when the container is in the closed position;

locking means to lock the opposing ends of the side panels to the bottom frame at least when the container is in the open position;

two opposing walls connected to the other opposing sides of the top frame and the bottom frame, the walls having predetermined fold lines therein between lateral surfaces to ensure the walls fold and unfold on the fold lines within the platform configuration; and means for raising the top frame to the open position, and for lowering the top frame to the closed position.

18. The container according to claim 17 further comprising two opposing multi layered flexible pyramidal shaped end portions joined at vertical corners to said opposing walls, the end portions extending under the side panels and the end portions having predetermined fold lines therein so the end portions fold and unfold on the fold lines together with the fold lines in said two opposing walls.

19. The container according to claim 17 wherein a plurality of collapsible strut members are located along the outside of the two opposing walls, pivot connections at one end of the strut members located on a side of one frame, and sliding connections at the other end of the strut members located on the side of the other frame, such that the collapsible strut members are substantially perpendicular to the top and bottom frame in the open position and substantially parallel to the top and bottom frame and within the platform configuration in the closed position.

20. The container according to claim 19 including cables connecting the sliding connections to a winch to provide the means for raising and lowering the top frame.

21. The container according to claim 17 including air cushions located under the side panels to provide the means for raising and lowering the top frame.

22. The container according to claim 17 including a trough extending downwardly below the bottom frame with at least one discharge outlet therein.

23. The container according to claim 22 wherein the trough has a flexible lining therein.

24. The container according to claim 23 including airline connection means for supplying pressurized air between the flexible liner and the trough.

25. The container according to claim 22 including at least one inflatable cushion within the trough which when inflated provides downward sloping surfaces to form a hopper shape directed to the discharge outlet.

26. The container according to claim 17 wherein the two opposing walls are made of multi layered flexible material.

* * * * *